United States Patent [19]

Rodriquez

[11] Patent Number: 4,871,332

[45] Date of Patent: Oct. 3, 1989

[54] NAVAL PROPULSION PLANT WITH HYDRAULIC TRANSMISSION

[75] Inventor: Riccardo Rodriquez, Messina, Italy

[73] Assignee: Nautical Propulsion Research Limited, London, England

[21] Appl. No.: 235,732

[22] Filed: Aug. 22, 1988

Related U.S. Application Data

[63] Continuation of Ser. No. 48,910, May 12, 1987, abandoned.

[30] Foreign Application Priority Data

May 12, 1986 [IT] Italy ..... 12475 A/86

[51] Int. Cl.[4] ..... B63H 21/165

[52] U.S. Cl. ..... 440/5; 440/4; 440/61; 440/81

[58] Field of Search ..... 440/3, 4, 5, 80, 81, 440/53, 61; 60/486

[56] References Cited

U.S. PATENT DOCUMENTS

| | | | |
|---|---|---|---|
| 811,986 | 2/1906 | Wilkinson | 440/5 |
| 1,297,130 | 3/1919 | Emmet | 440/3 |
| 1,910,561 | 5/1933 | Pierce | 440/81 |
| 2,393,234 | 1/1946 | Burgess | 440/80 |
| 2,766,715 | 10/1956 | Waterval | 440/5 |
| 3,285,011 | 11/1966 | Meyerhoff | 60/486 |
| 3,422,790 | 1/1969 | Connell | 114/124 |
| 3,469,556 | 9/1969 | Campbell et al. | 440/4 |
| 3,509,721 | 5/1970 | Crawford | 440/5 |
| 3,587,511 | 6/1971 | Buddrus | 440/5 |
| 3,602,184 | 8/1971 | Gratex | 440/5 |
| 3,673,978 | 7/1972 | Jeffery et al. | 440/5 |
| 3,888,083 | 6/1975 | Tone | 60/486 |
| 3,938,464 | 2/1970 | Gill | 440/80 |
| 3,983,833 | 10/1976 | Eickmann | 440/5 |
| 4,050,849 | 9/1977 | Sheets | 440/5 |

*Primary Examiner*—Sherman D. Basinger
*Assistant Examiner*—Thomas J. Brahan
*Attorney, Agent, or Firm*—Young & Thompson

[57] ABSTRACT

A naval propulsion plant that provides a pair of heat engines MT1 and MT2 that drive two independent pumps P1 and P2. In turn these pumps drive two hydraulic motors MR1 and MR2 with which two propellers E1 and E2 are solid in rotation. A suitable distributor 40 makes it possible to idle one of the two propellers in case of a breakdown, or to operate both with one of the heat engines.

5 Claims, 6 Drawing Sheets

152
151

51
52
54
53
56
60
55
63
64
57
62
58
59
58
61

NAVAL PROPULSION PLANT WITH HYDRAULIC TRANSMISSION

This application is a continuation of application Ser. No. 048,910, filed 5/12/87 now abandoned.

In the present technological situation the flexible properties of high-pressure hydraulics are used in an increasing number of stationary and mobile machines. An important characteristic of these hydraulic transmissions consists in the total freedom of choice in positioning the main engine.

This positioning therefore is no longer geometrically bound by positioning of the users as occurs in mechanical transmissions. This new possibility has brought a real revolution in the designing of numerous vehicles, since such machines have been able to be redesigned as a function of their use, arranging the main source of energy (heat engine, pump and regulating and distribution components) in a position corresponding to the general layout logic of the machine.

Another important characteristic consists in the possibility of a hydraulic plant for modulating the energy to use, in an optimal manner, the energy efficiencies of the main engine, while the values of torque and operating conditions or power and speed (depending on whether rotary or linear hydraulic motors are involved) can be varied within considerably broad limits. Naval means have benefited from this set of advantages in extremely narrow limits, in regard to propulsion of the means themselves.

It is intended therefore to propose, for use in navigation means, a propulsion plant with hydraulic transmission that better meets the requirements of modern navigation means.

By taking into account the characteristics of the variability of a hydraulic transmission it becomes possible, when used in naval propulsion, to increase the driving torque at the propeller under operating conditions. This facilitates, for example, the passage from displacing navigation to planing navigation for hydrofoil boats or increases the thrust force of the propeller of fishing boats during slow navigation with dragging of nets, while the voyage from and through the fishing zone is made at high speed since under such conditions the maximum thrust can be reduced to the advantage of higher speed.

One of the great obstacles which in the past has governed a widespread use of naval propulsion with hydraulic transmission was the low efficiency of the hydraulic transmission itself. In recent decades components have been developed for hydraulic transmissions functioning at high pressures and which have substantially improved the problem of overall efficiencies of the transmissions themselves.

A further decisive step was linked to the possibility of achieving totally reliable propulsion systems with contrarotating propellers. It has been known for more than a hundred and fifty years that propulsion with contrarotating propellers offers incomparably superior efficiencies in comparison with that of a single propeller.

Except in the case of torpedoes and in some aeronautical applications, propulsion with contrarotating propellers has not been resorted to because of the never solved problems of transmitting the rotating movement to the propellers by means of long coaxial shafts. The oscillating behavior of these coaxial shafts in the torsional and flexional direction does not provide sufficient reliability for embodiments in the naval field.

The invention which is described below consists above all in pairing rotating hydraulic motors placed in the immediate vicinity of a pair of contrarotating propellers and driving them. In this way first of all raising the problematic phenomena of torsional and flexional oscillation of the transmission shafts is avoided. In comparison with a traditional propulsion plant consisting of a main engine driving a single propeller by means of the shaft (supported at one or more points), the propulsion plant with hydraulic transmission with contrarotating propellers according to the invention guarantees a functioning with superior efficiencies in regard to the better efficiency of the contrarotating propellers in comparison with a single propeller. They not only produce a compensation of the lower efficiencies of the hydraulic transmission but notably increase the total efficiency of the propulsive system.

Another interesting aspect of this invention consists in the possibility of placing the energy source (heat engine) without having to respect other ties: the motor pump unit can equally be placed on the deck of the ship, at the stern or toward the bow, but also adjacent to the sides of the means or even in a crosswise position with respect to the direction of movement.

As a function of the most complete freedom offered to the designer, there is obviously the possibility of achieving overall savings of size and of improving the use of space that so far have not been known.

The proposed propulsion plant with hydraulic transmission with pairing of the contrarotating propellers reduces in a sensational way the vibrations and noises induced in the hull by the single propeller. The double contrarotating propellers mutually compensate for the vibrations and oscillations due to the pulses of the individual blades of the propeller. The distribution on two propellers of the power traditionally supported by a single propeller already in itself comprises a reduction of the oscillation phenomena, by transmitting to each propeller only a half power.

Thanks to the flexibility of the propulsion plant with hydraulic transmission with contrarotating propellers now described, the naval means for which it is intended can not only do without the traditional rudder by using the unit of hydraulic motors coupled to the contrarotating propellers as a variable direction jet but it is also possible to do so without a direction reverser, it being sufficient to rotate the unit of motors with contrarotating propellers 180 degrees to obtain the reversing of the propulsion forces at the maximum of their efficiency. Actually, it is known that the efficiency of single propellers made to rotate in the direction opposite to the normal operating direction is extremely low and the propulsive efficiency is also correspondingly low. Thanks to this type of system, maneuvering qualities of a precision and efficiency so far unknown are attained.

The achievement of the propulsion unit with hydraulic drive further provides the possibility of vertically raising or lowering the unit of hydraulic motors and the contrarotating propellers by adapting their position with respect to the hull under particular conditions of navigation (shoals) or of load.

A further orientation property consists in modifying the tilt of the propellers with respect to the direction of advance to obtain the maximum efficiency for propulsive thrust.

The device for tilting the propulsive unit is made so as to be able also to tip the propulsion unit upward, and thus out of the water, for inspection and maintenance, without resorting to beaching of the entire means.

This set of properties applies not only to the case of a unit under consideration as a stern unit but also to an arrangement below the hull; in this case a "vanished" embodiment being possible, i.e., with the total withdrawal of the unit inside the hull, opens up extremely interesting new prospects not only for the use of special operating means but also ideal auxiliary propulsion with special means (military craft) and sailboats. Also in these cases the "orientable" embodiment guarantees characteristics of maneuverability not known until now for the maneuverability of naval means.

An important improvement for navigation reliability is achieved, according to the invention, by using two diesel engines that, with the interposition of the hydraulic motors, feed two propellers. In the case of breakdown of one of the heat engines, it is possible to continue the voyage by operating both propellers by means of a single heat engine. In this case, as a result of a suitable positioning of some two-way, two-position valves (for example, a ball valve) the power generated by a single heat engine is transmitted to at least two hydraulic motors which, for their part, transmit the movement to the two propellers.

Even in the case of a serious breakdown of one of the propellers, which does not allow its subsequent use on the naval means, the possibility of continuing the voyage is assured: in this case the broken propeller is excluded from feed of the pumps as a result of operating some distribution elements. The operation of the ship then takes place solely by one propeller for whose feed only one heat engine or even both are used. During the navigation the broken propeller is driven idle together with the hydraulic motor or motors connected to them.

In both situations described the maneuverability and navigation reliability still remain assured. A considerable advantage results from this in comparison with traditional operating solutions in which each heat engine is connected to its propeller by a separate shaft. These propellers are placed on the left or right with respect to the median plane of the naval means.

Consequently, following the breakdown of a heat engine and a propeller, the remaining propulsive energy is generated at the second heat engine and the second propeller operates off-center, compromising both the maneuverability and navigation reliability of the means. The propulsion plant according to the invention further makes it possible to use the heat engine, driving the on-board generator, as an auxiliary source of energy for propulsion if the engine or main engines are broken down, or if it is necessary to navigate for long periods and at slow speed, as, for example, in the case of navigation on inland canals or in the case of trawling.

In these latter two actions, the propulsion by means of the main engine is not only uneconomical but also harmful for the life of the engine itself. In this case it is sufficient to operate with the auxiliary heat engine, besides the on-board generator and a pump which—in case of need—is connected to the propulsive system by means of two-way, two-position valves.

These objects, advantages and characteristics of the invention will become more apparent from the following description relating to embodiments selected solely by way of example with particular reference to the accompanying sheets of drawings in which:

FIG. 1 diagrammatically illustrates, partially in section, a design solution of the propulsion unit, formed by two coaxial hydraulic motors and two contrarotating propellers;

Figure 5:
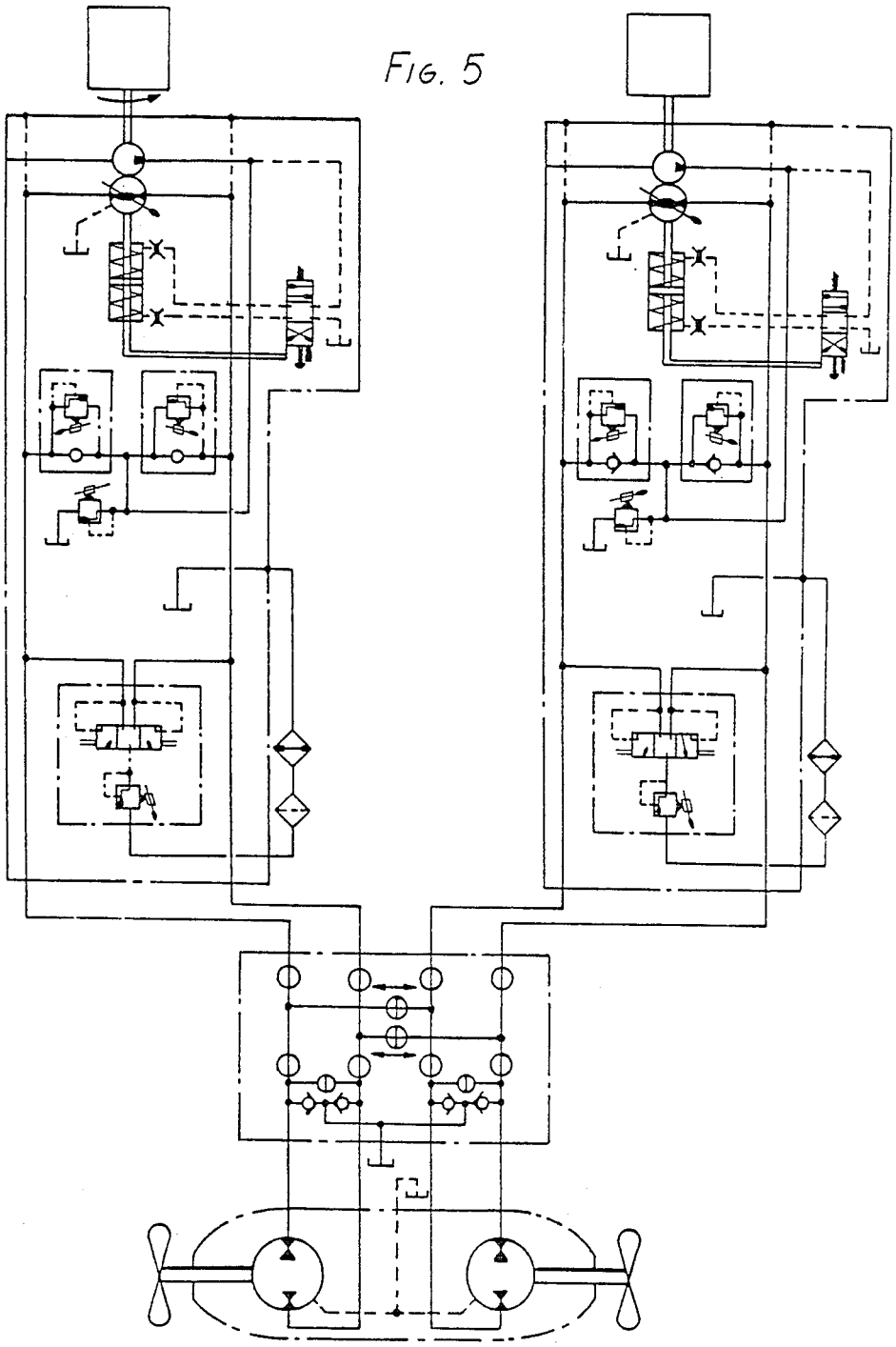
Figure 6:
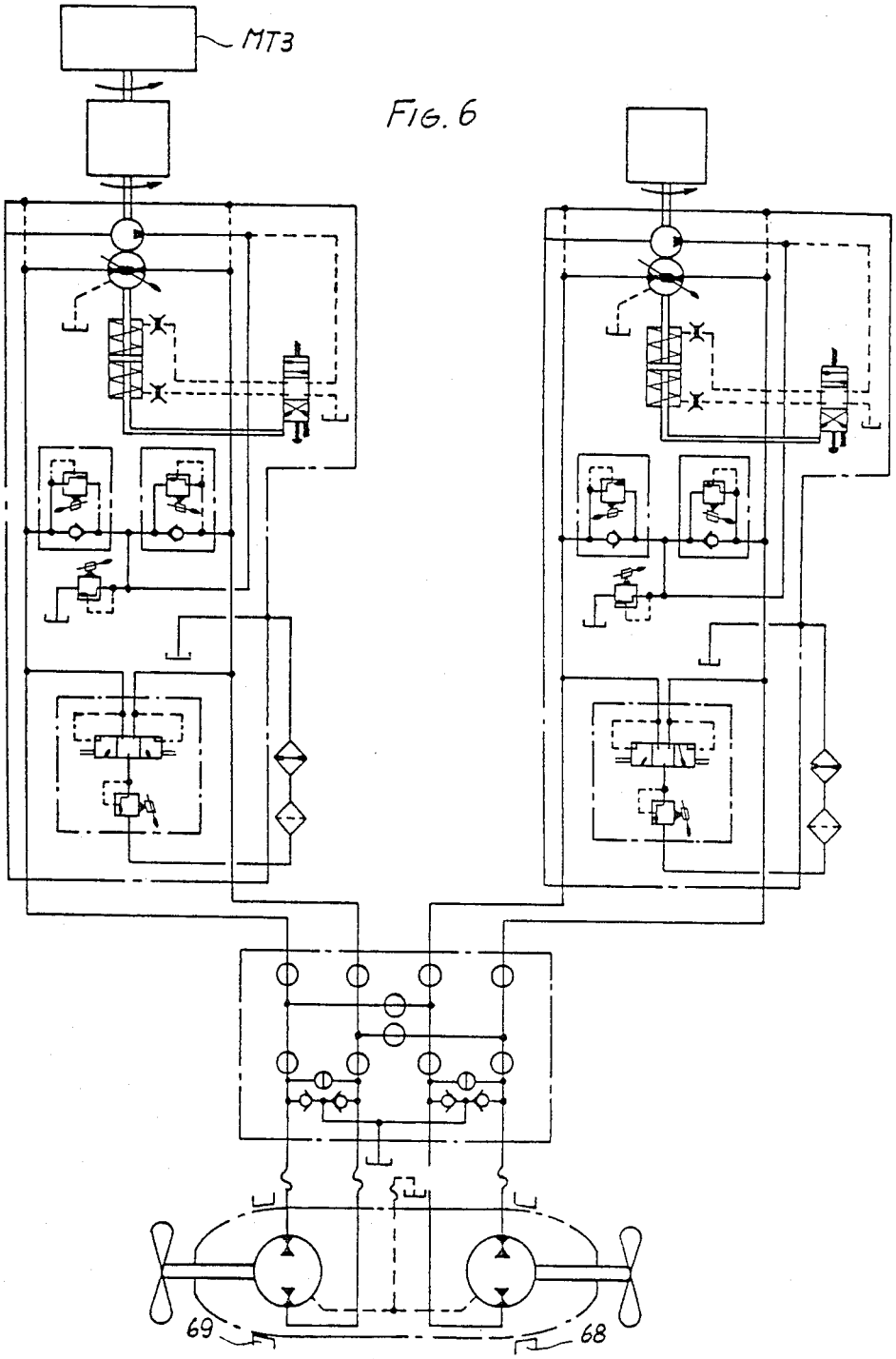
Figure 7:
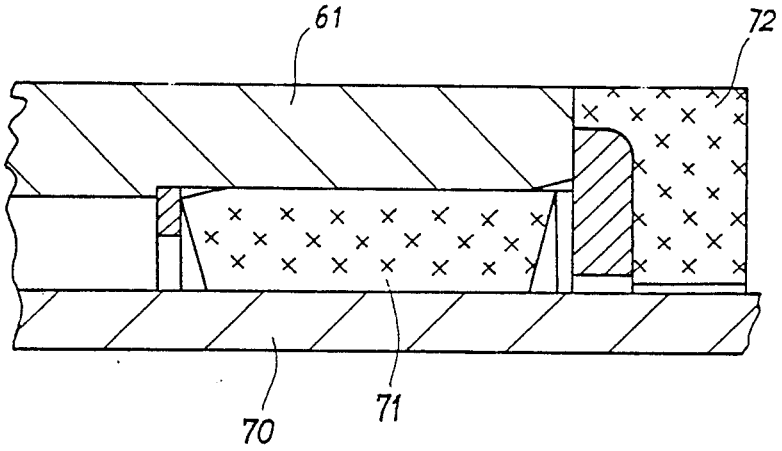

FIG. 5 relates to the case in which one of the two heat engines and the relative pump are out, while the two propellers are moved by the other pump driven by the single heat engine in operation;

FIG. 6 finally shows the particular case in which, the power required for the propulsion being very modest, both main heat engines are inactive; in this case, one of the pumps is driven by the heat engine of the on-board generator which in this case performs three functions: feeds the on-board electric plants, and drives, by one of the two pumps, the two propellers fed in parallel by the same hydraulic circuit;

FIG. 7 shows an example of elastic suspension of one of the propulsion units.

Figures 1, 2:
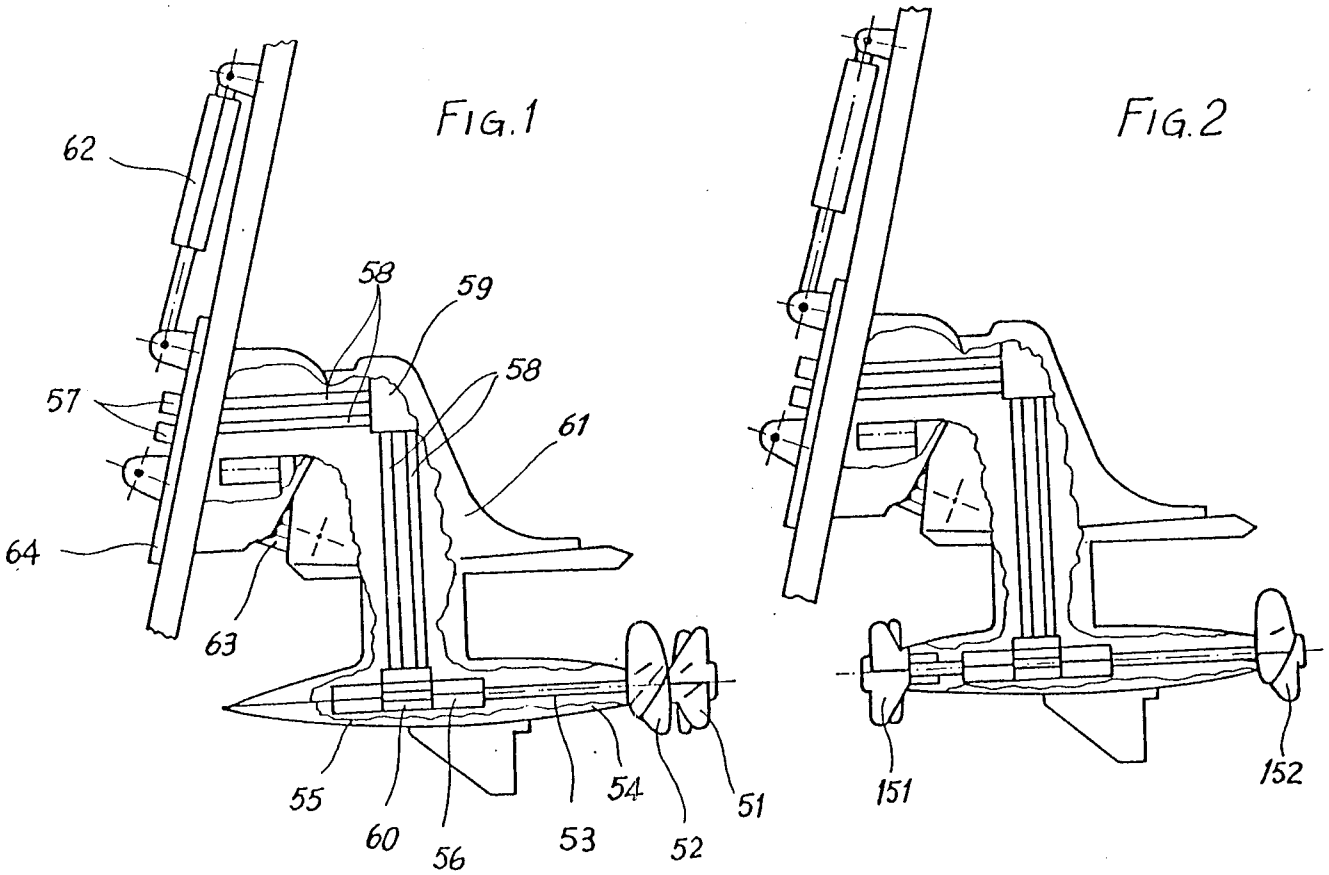
FIG. 2 is an alternative solution to the solution illustrated in 1, in which the two hydraulic motors drive two propellers placed in tandem, i.e., a thrusting propeller and a pulling propeller.

With reference to FIG. 1, the propulsion system consists first of all of two contrarotating propellers 51, 52 which are driven by means of two short coaxial shafts 53, 54 by at least a pair of hydraulic motors, preferably piston motors 55, 56.

These motors are arranged coaxially with the propellers and the motors transmit the rotary movement, in the opposite direction with respect to one another, to the propellers through a system of coaxial shafts: outside motor 55 and propeller 51 are connected to one another by a solid propeller shaft while inside motor 56 and inside propeller 52 are connected by a hollow shaft arranged coaxially with respect to the solid shaft.

Besides the propulsion system with contrarotating propellers, both acting with thrust or pull, it is possible to achieve a second configuration (FIG. 2)—equally valid with the use of a pulling propeller 151 and a thrusting propeller 152—each of which is driven by one or more hydraulic motors 155 and 156. In this case, both shafts are solid. Hydraulic feeding with oil under pressure for the two motors takes place by outside connections 57, piping 58, rotating joints 59 and a distribution unit 60, common to the two motors.

The distribution unit, motors, shafts and necessary supports are housed on the inside of an orientable body 61 which transmits the thrust of the propellers to the hull through rotating joints 59. The joint rotating on its vertical axis makes the orientable body assume the function of a rudder, consequently allowing a rotation of 180 degrees to reverse the direction of travel. (This joint is made so as to transmit the flow of the oil under presure and the return flow of the hydraulic motors, besides that of the blowbys.)

The system is designed so that, besides the rotation movement around the vertical axis to give direction to the naval means, there is the possibility of rotation around an orientable horizontal axis for a correction in the propulsive direction (trim) and to tilt the entire propulsion unit upward for maintenance. Vertical translation of the propulsive body is further provided for navigation in shallow waters and for adaptation of the immersion of the propeller to the load conditions.

Performance of the various movements now described is achieved by rotating hydraulic or hydraulic cylinder motors 63 or by electric motors. The unit is completed by plate (64) for connection with the ship and preferably flange-mounted to transom 65 of the naval means.

Synchronization of the propellers can be assigned simply to the action itself of the propellers in the water or to a mechanical or also hydraulic system, for example, by means of a feed independent of any unit of propeller-driven motors.

Figure 3:
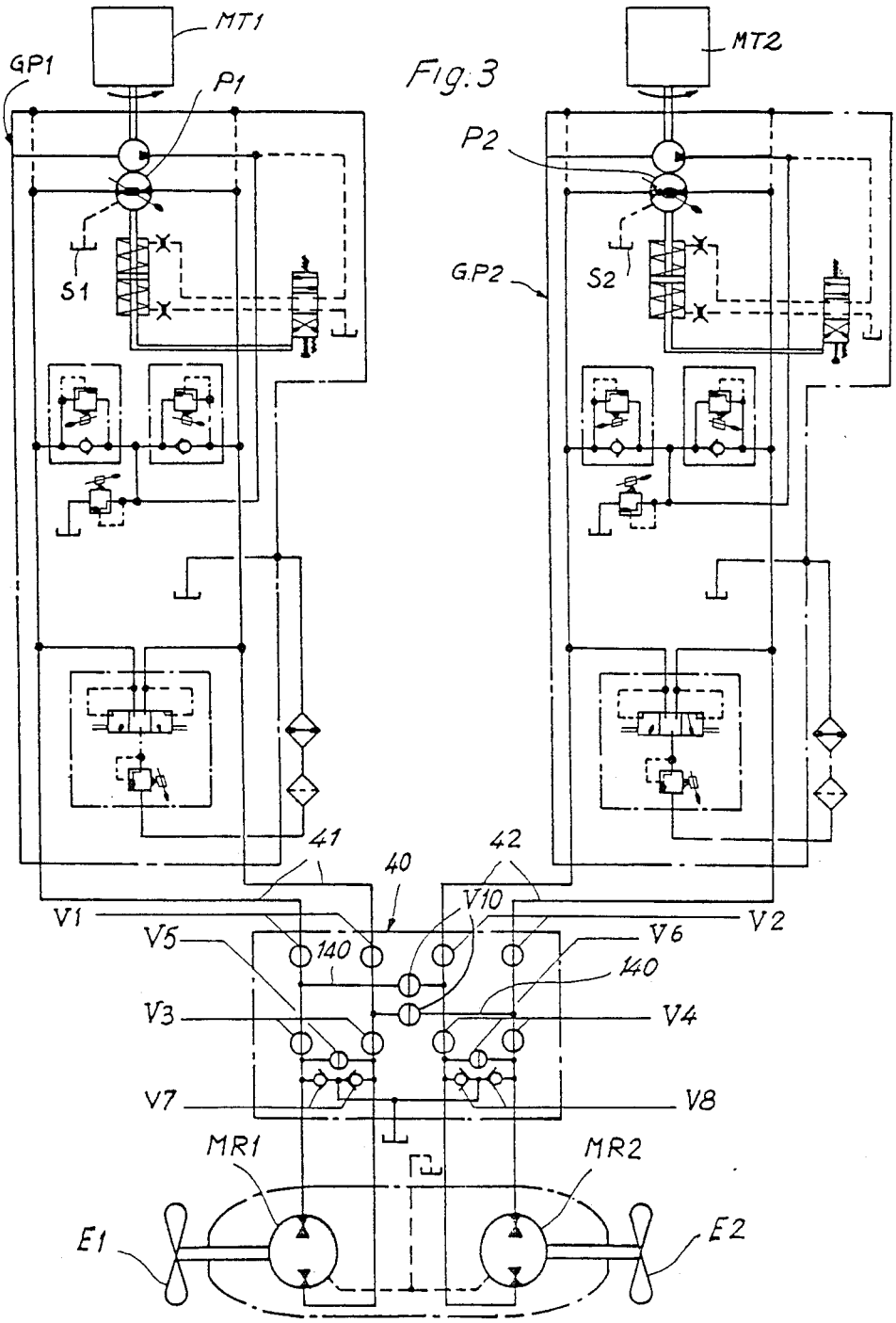
FIG. 3 represents diagrammatically, as a whole, the propulsion plant with hydraulic transmission according to the invention, applied to the case in which two propellers, arranged in the mode illustrated in FIG. 2, are each associated with a heat engine driving a pump, with the possibility of interconnecting the hydraulic systems of the two units as illustrated in FIGS. 4, 5 and 6 below.

The plant engineering solution of a naval means equipped with two heat engines MT1 and MT2 is shown diagrammatically in FIG. 3. Each motor is associated with a pump unit GP1 and GP2, whose basic element is made up of two pumps P1 and P2 and a pair of lines 41 and 42. S1 and S2 indicate the tanks of pumps P1 and P2 into which all losses and overflows of the plant from the various positions return.

Through a distributor 40, which will be described below, the two pairs of lines 41 and 42 feed the two hydraulic motors MR1 and MR2 which in turn drive the rotation of the two propellers E1 and E2. These two propellers obviously can be arranged in either one of the two modes illustrated in preceding FIGS. 1 and 2.

Distributor 40 provides above all a pair of connectors 140 which can be cut off by a corresponding pair of valves V10 by means of which both hydraulic motors MR1 and MR2 can be fed by only one of the two pumps P1 and P2. For this purpose, upstream from connectors 140 the pair of lines 41 and 42 are equipped with a pair of valves V1 and V2. A second pair of cutoff valves V3 and V4 is placed on the pair of lines 41 and 42 immediately downstream from the pair of connectors 140. Downstream from this pair of cutoff valves V3 and V4 each pair of lines 41 and 42 provides a bypass connector on which is placed a valve V5 or V6. Pairs of calibrated valves V7 and V8 complete distributor 40.

When total power is required, both heat engines MT1 and MT2 are in operation and the pair of pumps P1 and P2 operate corresponding hydraulic motors MR1 and MR2. The hydraulic circuits are independent and distributor 40 has the valves arranged as illustrated in FIG. 3; the four pairs of valves V1–V2, V3–V4 are open. The two valves V10, on the one hand, and the two valves V5 and V6, on the other hand, are closed.

Figure 4:
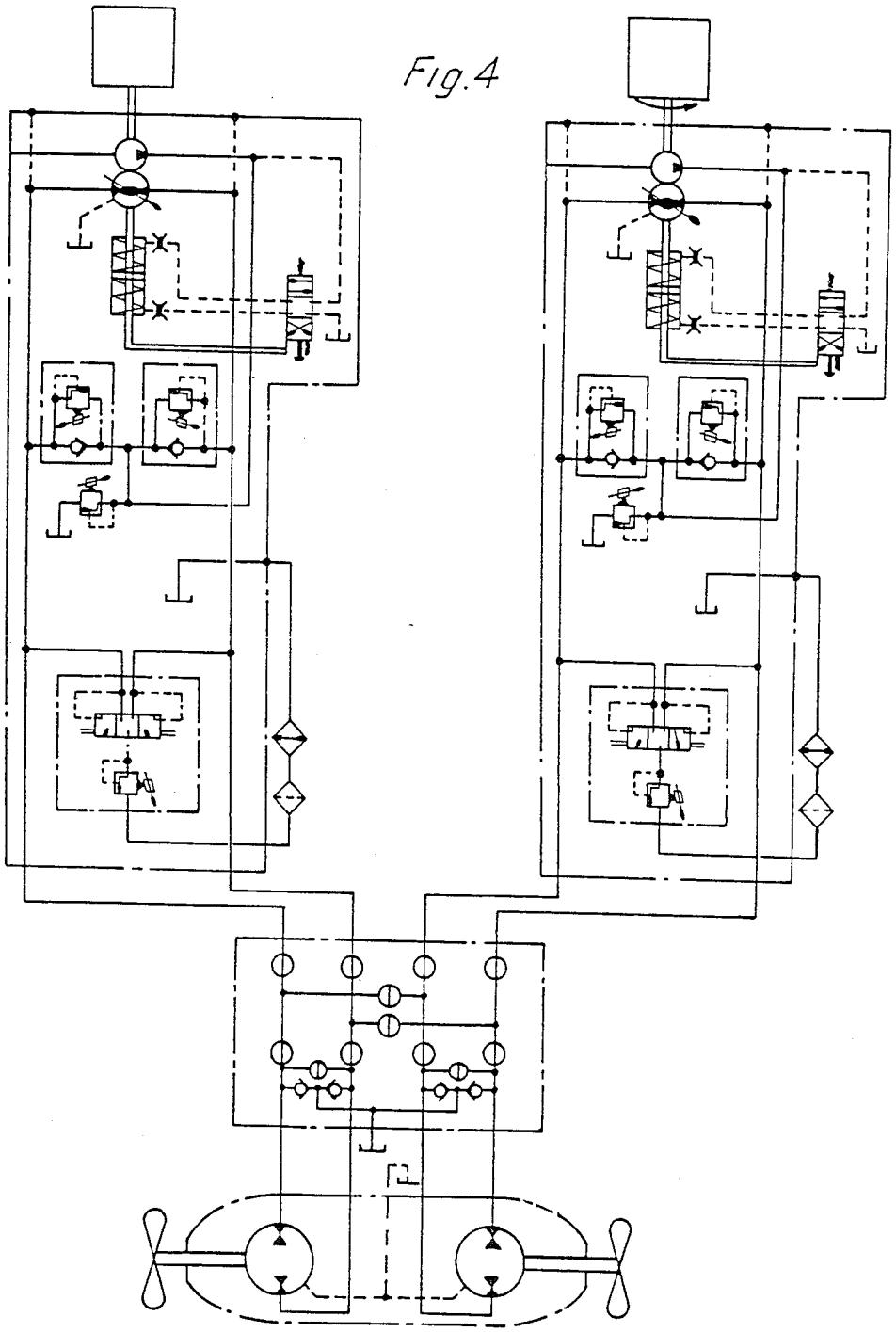
FIG. 4 is similar to FIG. 3 but relates to the case in which a heat engine and/or the relative pump, on the one hand, and a hydraulic motor, on the other hand, are broken down at the same time.

In FIG. 4, on the contrary, is illustrated the limit case in which both pump unit GP1 and hydraulic motor MR1 are broken down. In this case only heat engine MT2 which drives pump P2 is in operation. The pair of lines 42 feeds hydraulic motor MR2 which drives propeller E2. Valves V2 and V4 are open, as in the preceding case and similarly valves V10 and V6 are closed.

The situation is different in regard to the left unit: in this case propeller E1 is idle and for this it is necessary, as shown in FIG. 4, that bypass valve V5 be open. One or both pairs of valves V1 and V3 can be closed.

FIG. 5 shows another possibility of functioning of the propulsion plant according to the invention: the diagram of FIG. 5 refers to three possible cases, in the first of which, a reduced power being required, only a single heat engine (MT1) and a single pump unit (GP1) are in operation. However, both propellers are in operation thanks to a suitable play of the valves allowed by distributor 40.

With respect to the solution illustrated in FIG. 3, valves V2 are closed and valves V10 are opened. In this way hydraulic motor MR2 is fed by the pair of lines 41 coming from unit GP1. This arrangement could also be used when one of the two heat engines or one of the two pump units GP1 or GP2 is broken down.

On the other hand, when only a reduced cruising speed is required of the craft, this arrangement allows one of the two units to operate at maximum power, while keeping the other one shut off, i.e., it comprises notable savings.

The arrangement shown in FIG. 6 refers to the particular case in which only a very small power is required of the craft. This happens, for example, in case of movements at very slow speeds, for example, in port or for a fishng boat when it has to let out the fishing net. In this case, as already illustrated in FIG. 5, both propellers are driven by the same hydraulic unit GP1. However, pump P1 of this unit rather than being moved by the corresponding main heat engine MT1, is driven, by means of a suitable uncoupable joint, not shown in the figure, directly by the on-board generator, indicated by MT3.

Still within FIG. 6, 68 diagrammatically shows the propulsor support system that connects it to the naval means. On the other hand, 69 indicates elastic means that make it possible to absorb noise and vibrations of the propulsion unit and to avoid its transmission to the hull structures. In this, obviously also the feed piping should be elastic (hoses) as, moreover, is indicated in the same figure.

FIG. 7 indicates a possible example of embodiment of such elastic elements. It is a series of rings (a group of rings is shown in section) which are applied between the hydrostatic propulsor and the support that connects the same propulsor to the hull.

In this FIG. 7, 70 indicates the cover of the unit comprising two hydraulic motors and two propellers. Between support 61 and cover 70 is provided a first annular elastic element 71 that absorbs the radial components, and a second annular elastic element 72 that absorbs the axial components.

Although for descriptive reasons, this invention was based on what was described above with particular reference to the accompanying drawings, many modifications and variants can be made in the embodiment of the invention; however, these modifications and variants should be considered as comprehended by the following claims.

I claim:

1. Naval propulsion plant comprised of:

(a) a main engine, (b) a pump operated by said main engine, (c) a naval propulsor driven by said pump, said naval propulsor including a single propeller, and (d) a hydraulic flow circuit connecting said pump and said naval propulsor, with each said main engine, pump, hydraulic circuit and naval propulsor being present in pairs capable of independent operation, with said single propellers of said paired naval propulsors consisting of contrarotating propellers in relation to each other, and (e) a hydraulic flow distributor positioned between said respective pairs of pumps and naval propulsors and common to each said hydraulic circuit, said hydraulic flow distributor including means to maintain independent operation of each said hydraulic circuit as well as to connect either of said pumps with both of said naval propulsors, said propulsion plant comprising two parallel and symmetrical units, each formed by one said main engine, one said pump, a hydraulic motor and one said propeller, wherein said propellers, driven by said hydraulic motors, are mounted on a support, and further including means for rotation of said support about a horizontal axis and means for rotation of said support about a vertical axis, and wherein each said hydraulic motor and each respective driven propeller are mounted on said support by at least a pair of elastic supports able to absorb the radial and axial forces developed by said propellers.

2. Naval propulsion plant according to claim 1 wherein said contrarotating propellers are mounted in tandem, of which one propeller is pulling and one propeller is thrusting.

3. Naval propulsion plant according to claim 1, wherein said distributor is equipped with bypass means for each of the two hydraulic motors which allow each of the two propellers to be idled together with the respective hydraulic motor.

4. Naval propulsion plant according to claim 1, further including means that can be cut off between at least one of said pumps and a third main motor comprised of a motor of an electric generating unit.

5. Naval propulsion plant according to claim 1, wherein said rotation means comprises hydraulic jacks.

* * * * *